United States Patent [19]

Weirick et al.

[11] 3,985,981

[45] Oct. 12, 1976

[54] PROGRAM SWITCH ASSEMBLY HAVING ADJUSTABLE CONTACT STRUCTURE

[75] Inventors: Richard A. Weirick, Grandville; Jerry L. Donihue, Battle Creek, both of Mich.

[73] Assignee: Gulf & Western Manufacturing Company (Hastings), Southfield, Mich.

[22] Filed: Mar. 26, 1975

[21] Appl. No.: 562,225

[52] U.S. Cl. ..... 200/25

[51] Int. Cl.[2] ..... H01H 19/00

[58] Field of Search ..... 200/23–26, 200/28, 29, 30 R, 31 R, 9, 14, 38 C, 38 CA; 310/241; 321/50

[56] References Cited

UNITED STATES PATENTS

| | | | |
|---|---|---|---|
| 1,602,934 | 10/1926 | Quill | 200/25 X |
| 2,353,014 | 7/1944 | DuRoza et al. | 200/25 X |
| 2,723,319 | 11/1955 | Sebring et al. | 200/25 |
| 2,756,293 | 7/1956 | Bitler | 200/25 |
| 3,247,334 | 4/1966 | Sebring | 200/25 X |
| 3,510,610 | 5/1970 | Jones, Jr. et al. | 200/25 |

*Primary Examiner*—James R. Scott
*Attorney, Agent, or Firm*—Meyer, Tilberry & Body

[57] ABSTRACT

A rotary program switch is disclosed including a housing supporting a commutator for rotation. The commutator includes a plurality of axially spaced contact tracks, and a corresponding plurality of brush elements are supported in the housing for engagement with the tracks in response to rotation of the commutator. Certain of the brushes are mounted on a rotatable gear for selectively positioning the brushes relative to the housing from outside the housing, and the latter brushes are adjustably mounted on the gear. Others of the brushes are carried by a support arm reversibly mountable within the housing to selectively position the brushes in generally diametrically opposed locations in the housing. The support arm, in either position, is adjustable relative to the housing. The several adjustments enable performance of a desired switching program in response to rotation of the commutator in opposite directions relative to the housing.

19 Claims, 16 Drawing Figures

FIG. 3
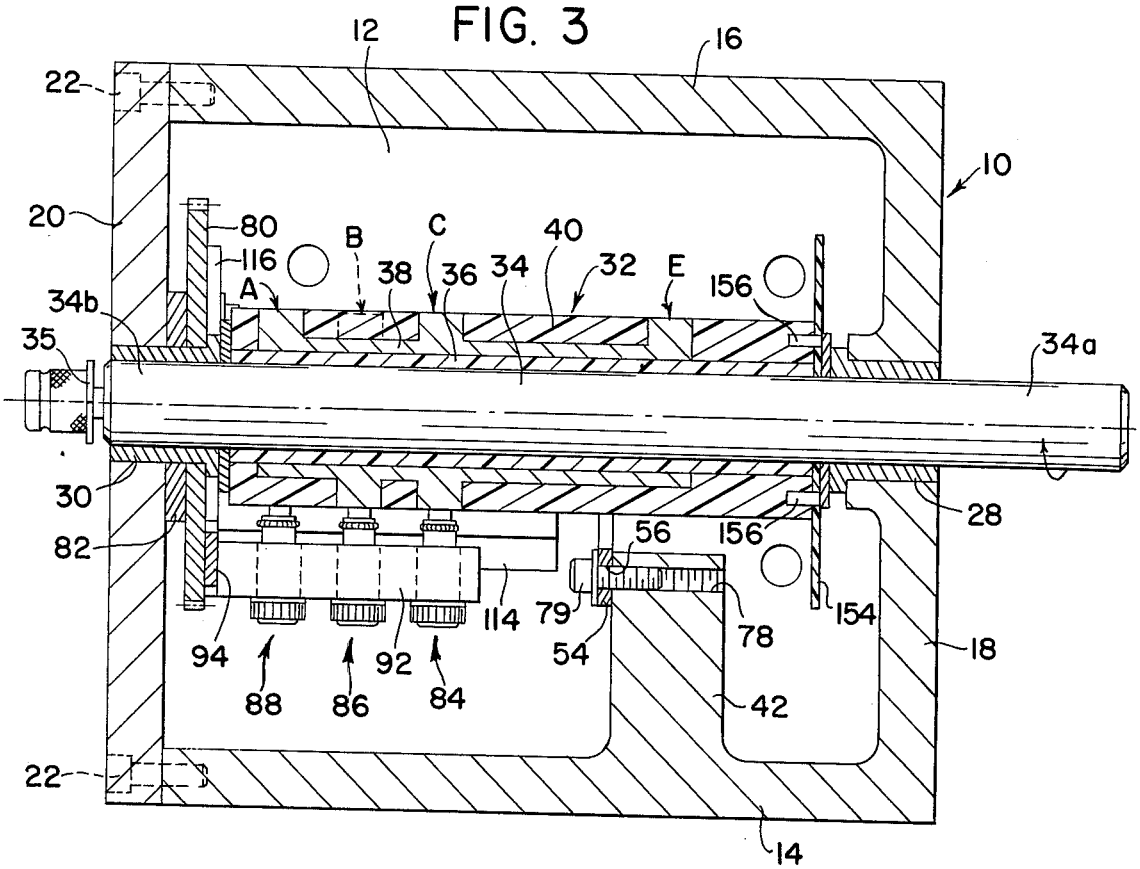
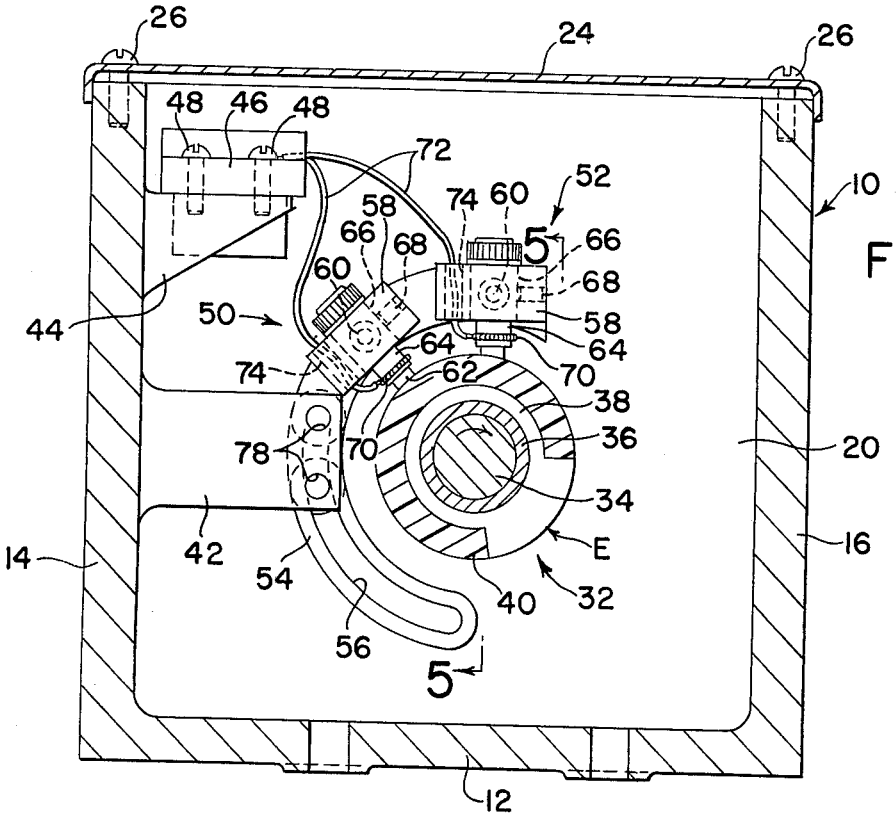
FIG. 4

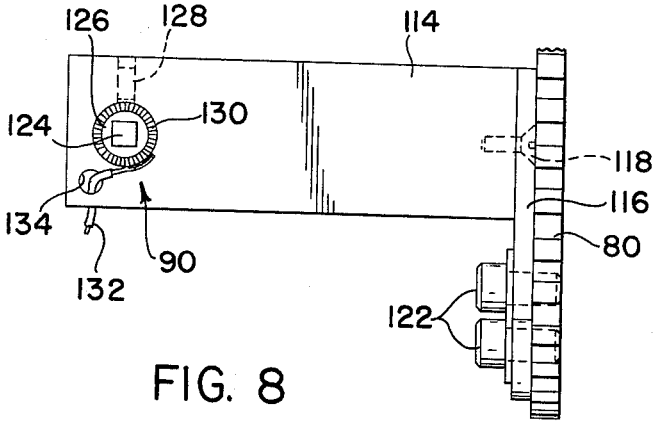
FIG. 8
FIG. 9
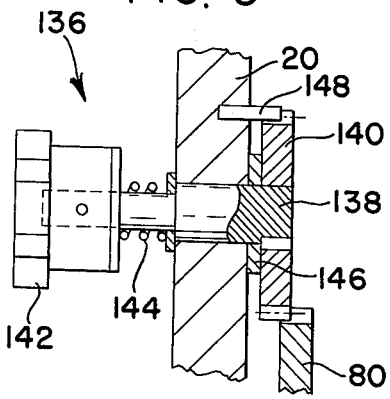
FIG. 10
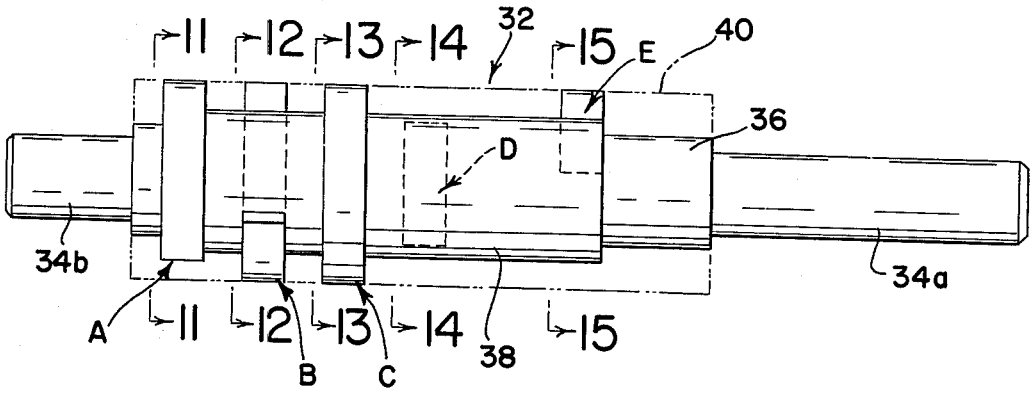
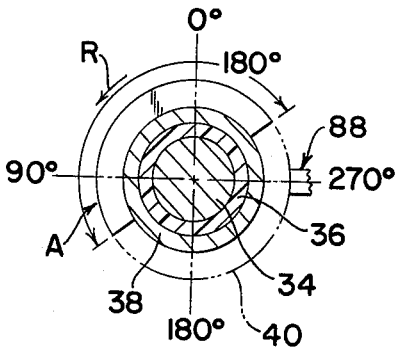
FIG. 11
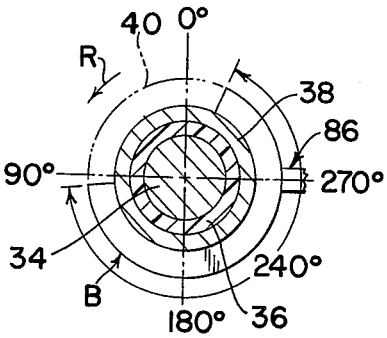
FIG. 12

FIG. 13
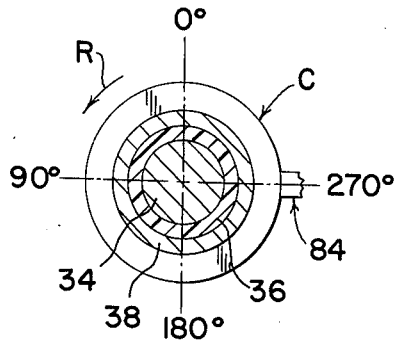
FIG. 14
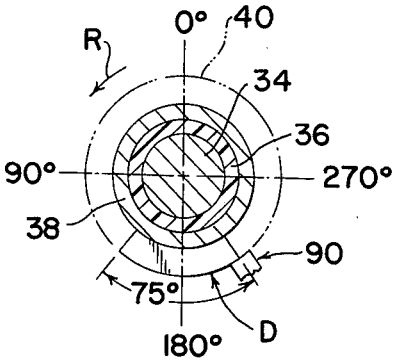
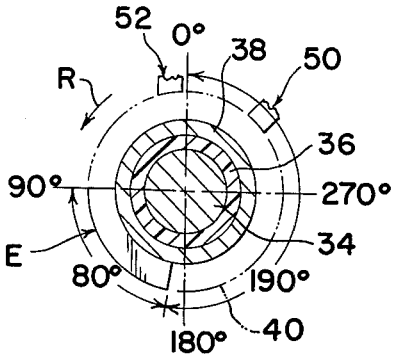
FIG. 15
FIG. 16
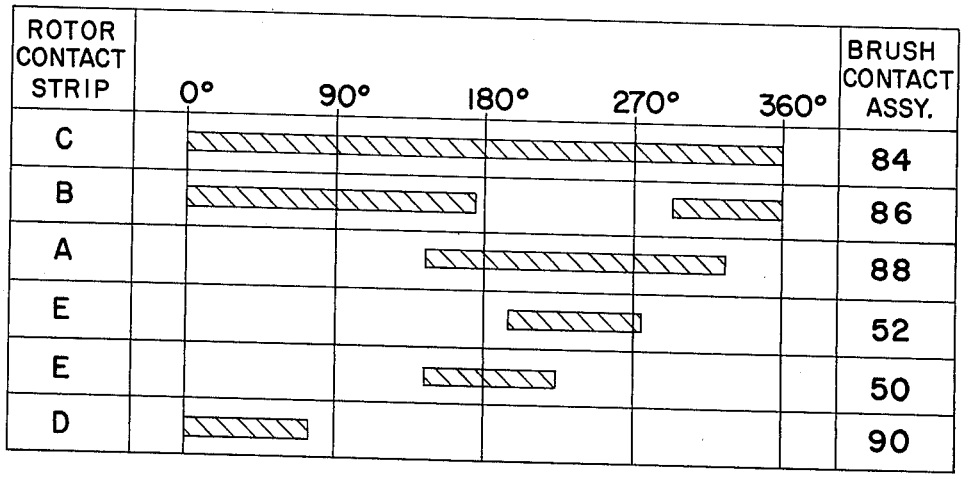

PROGRAM SWITCH ASSEMBLY HAVING ADJUSTABLE CONTACT STRUCTURE

This invention relates to the art of rotary electric switches and, more particularly, to an improved rotary switch in which multiple adjustments can be made with regard to the opening and closing of the switch contacts.

Electrical switches of the character to which the present invention is directed have many uses including the controlling of sequential functions in the operation of metal working presses and the like. In such use, the rotary switch is driven by a press so as to operate in synchronism therewith, and the switch includes a rotor or commutator carrying one or more switch contacts cooperably engaging fixed contacts to achieve switching functions in a desired sequence during rotor rotation.

It is most desirable in a switch of this character to provide for adjusting the positions of the fixed contacts relative to one another and to the housing or other support therefor. This enables varying the point of make and/or break contact with the rotor carried element, and many arrangements have been provided heretofore for achieving such adjustment capability. Moreover, it is desirable to provide for the rotor to be adapted to be driven in opposite directions relative to the support therefor so as to permit selective placement of the switch unit with regard to the direction of rotation of a take-off shaft of the press by which the switch is driven. Still further, it is desirable to provide for at least certain of the fixed contacts in the housing to be adjustable from outside the housing during use of the switch so that minor adjustments of the make and break points with regard to these switch contacts can be made without shutting down the press.

Various arrangements for contact adjustment have been provided heretofore in rotary program switches. In this respect, for example, adjustment of the fixed contacts relative to one another and to a support housing has been provided for as has adjustment of the fixed contacts relative to the support housing from outside the housing and during operation of the press. Previous efforts to achieve the desired adjustments, however, have resulted in program switches which are undesirably large in size and in which the adjusting mechanisms are structurally complex. Moreover, while certain contact adjustments are provided for in one device and other adjustments are provided for in another device, all of the desirable adjustments and the versatility sought in connection with rotary program switches has not been obtainable in a single compact, economic program switch package.

In accordance with the present invention, an improved rotary program switch is provided which is comprised of a minimum number of parts structurally interrelated to provide a compact switch unit which is more versatile than similar switches heretofore provided. Moreover, the switch structure enables both major and minor adjustments of the fixed contacts relative to one another and to the support structure, and enables achieving the same program functions in response to rotor rotation in opposite directions. More particularly, in accordance with one aspect of the invention, a fixed contact in the form of a brush, for example, is carried on a support arm which is reversably mountable in a switch housing to provide for the brush to be selectively positioned in generally diametrically opposed locations in the housing. Moreover, the support arm and thus the brush is circumferentially adjustable relative to the housing in each of the two modes of orientation thereof. In accordance with another aspect of the invention, a fixed contact element such as a brush is carried by a support arm which is mounted on a member rotatable relative to the rotor axis, preferably 360°, whereby the support arm and thus the brush is selectively positionable in generally diametrically opposed locations in the housing by rotation of the support member. Further, the latter support arm is adjustably mounted on the rotatable support member, whereby the brush can be adjusted relative to the support member. Preferably, the rotatable support member is adjustable relative to the housing, in increments, to further provide for fine adjustments of the brush position relative to the housing.

For a given program defined by the fixed contacts and electrical contacts on the rotor, the ability to position the brushes in diametrically opposed locations relative to the housing enables achieving the same program of switch make and break functions in response to rotation of the rotor in opposite directions. Moreover, the adjustment capabilities of the brushes relative to the housing advantageously enable positioned adjustment of the brushes relative to each of the opposed locations of orientation to obtain contact make and break at a desired time or point with respect to rotor rotation. Still further, the incremental adjustment of the rotatable support member advantageously enables fine adjustment of the corresponding brush or brushes from outside the housing and during operation of the press.

In accordance with another aspect of the invention, a motion sensing arrangement is provided between the rotor and switch housing to sense rotation of the rotor and to produce an electrical output signal indicative of the speed of rotation. The output signal advantageously can be employed to actuate a control mechanism to declutch and/or stop the press in the event that the rotor speed is above or below a predetermined speed.

It is accordingly an outstanding object of the present invention to provide a rotary program switch having improved adjustment capabilities with respect to the location of fixed contact elements of the switch relative to a support therefor.

A further object is the provision of a rotary program switch having improved contact adjustment capabilities which enhance achievement of the same switch contact make and break functions in response to rotor rotation in opposite directions.

Still another object is the provision of a rotary switch of the foregoing character in which a fixed contact is selectively positionable in generally diametrically opposed locations relative to the support therefor and is additionally adjustable relative to the support in each of the locations.

Another object is the provision of an improved rotary switch including a housing in which a fixed contact element is mounted on a rotatable support member coaxial with the rotor axis, in which the position of the rotatable support member is adjustable from outside the switch housing, and in which the contact element is mounted on the rotatable support member for adjustment relative thereto.

Yet another object is the provision of an improved rotary switch of the foregoing character including an arrangement within the housing for sensing the speed of rotation of the switch rotor and producing a signal indicative of the speed of rotation.

Still another object is the provision of a rotary switch comprised of a minimum number of parts structurally interrelated to provide a compact switch unit which is economical to produce and maintain, which has multiple adjustment capability with respect to the fixed contacts thereof, and in which a desired sequence of switch make and break functions can be obtained with respect to rotor rotation in opposite directions relative to the switch housing.

The foregoing objects, and others, will in part be obvious and in part pointed out more fully hereinafter in conjunction with the written description of a preferred embodiment of the invention illustrated in the accompanying drawings in which FIG. 1 is a side elevation view of a rotary switch made in accordance with the present invention;

FIG. 3 is a sectional view of the switch taken along line 3—3 in FIG. 1;

FIG. 4 is a sectional elevation view of the switch taken along line 4—4 in FIG. 1;

FIG. 8 is a detail view of yet another brush assembly of the switch taken along line 8—8 in FIG. 6;

FIG. 9 is a cross-sectional elevation view of an adjusting mechanism of the switch taken along line 9—9 in FIG. 2;

FIG. 10 is a side elevation view of the commutator of the switch;

FIGS. 11–15 are sectional elevation views of contact portions of the commutator taken along lines 11—11 through 15—15 in FIG. 10; and, FIG. 16 is a program chart for the switch.

Figure 1:
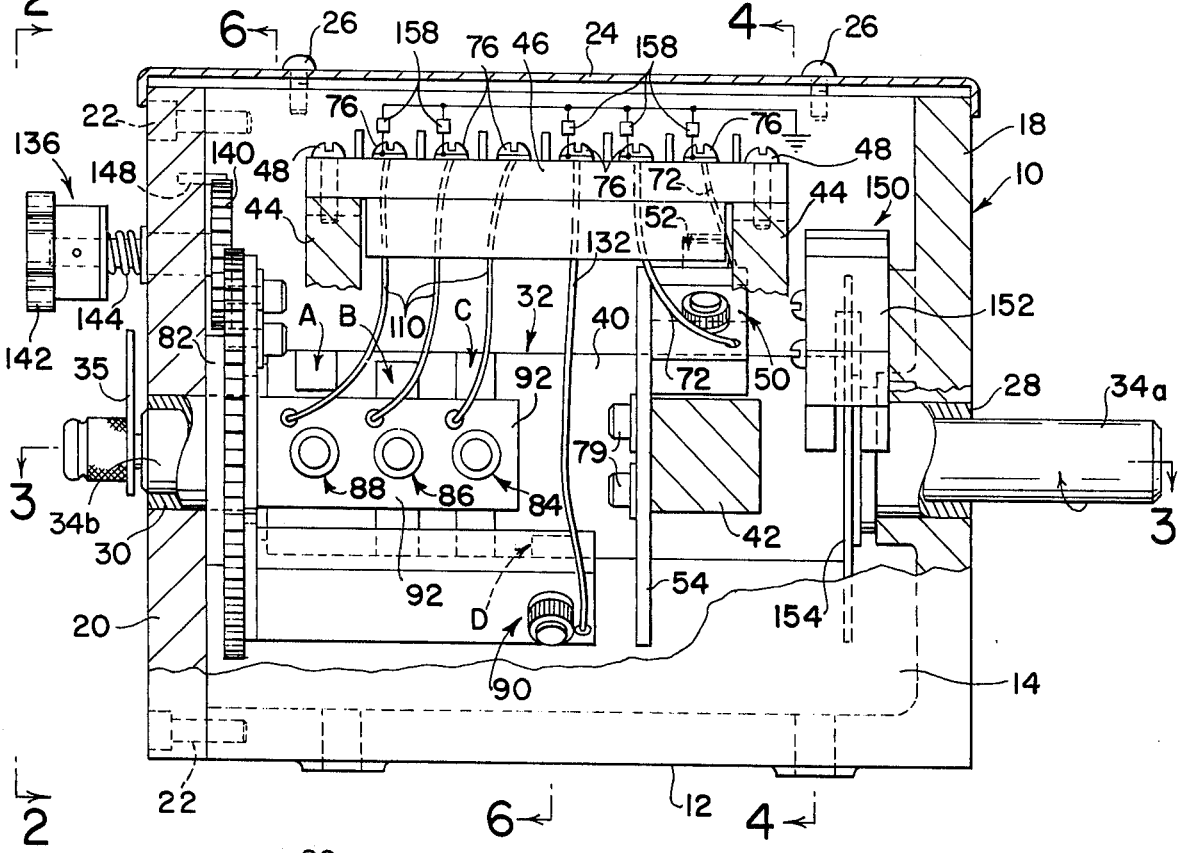
Figure 2:
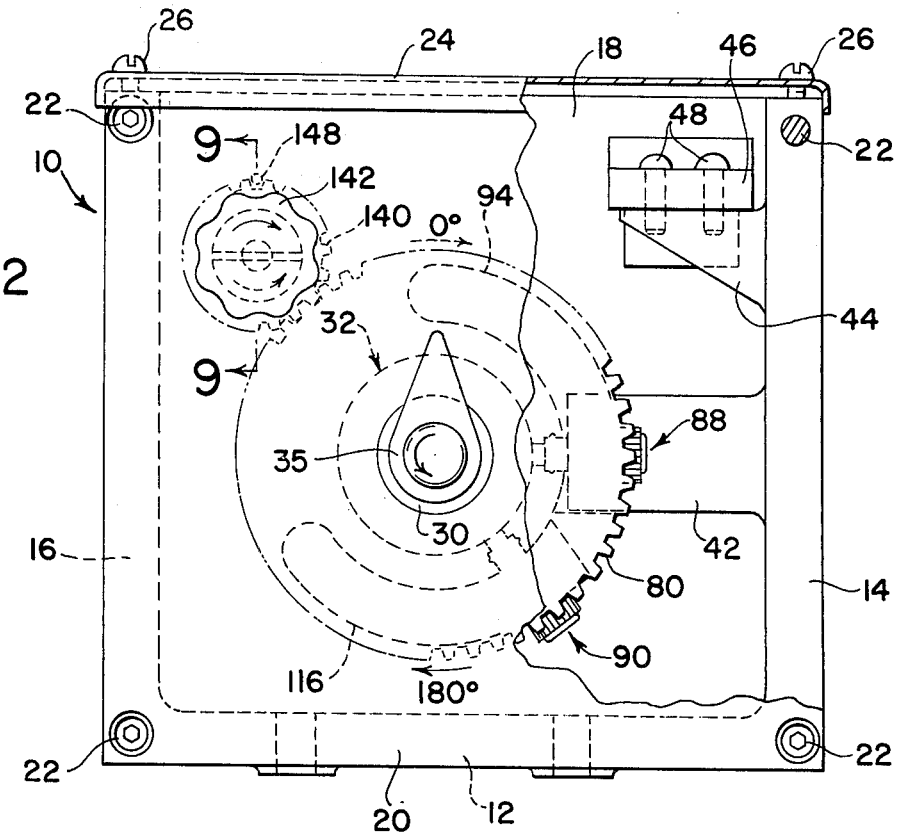
FIG. 2 is an end elevation of the switch as seen along line 2—2 in FIG. 1.

Referring now in greater detail to the drawings wherein the showings are for the purpose of illustrating a preferred embodiment of the invention only and not for the purpose of limiting the invention, a commutator type program switch is illustrated which, as seen in FIGS. 1–4, includes a housing 10 having a bottom wall 12, sidewalls 14 and 16 and a rear wall 18, which walls in the embodiment shown are integral with one another. The housing further includes a front wall 20 removably attached to sidewalls 14 and 16 such as by screws 22, and a top wall 24 removably attached to sidewalls 14 and 16 such as by screws 26. Rear wall 18 and front wall 20 are provided with aligned apertures receiving bearing sleeves 28 and 30, respectively, which support the opposite ends of the shaft component of a rotor or commutator 32.

In the embodiment shown, commutator 32 is comprised of a shaft 34 on which a sleeve 36 of suitable electrical insulating material is bonded. A machined program cam 38 of bronze is bonded to sleeve 36 and includes a hub portion and a plurality of radial projecting axially spaced cam segments, as described more fully hereinafter. The commutator further includes a fiber glass portion 40 which is provided by initially molding fiberglass about shaft 34 sleeve 36 and cam 38. The fiberglass is then machined down to the diameter of the cam segments to expose the outer surfaces thereof, thus to provide a plurality of circumferentially extending contact tracks. End 34a of the shaft is adapted to be coupled with the press or other mechanism to be controlled, and end 34b is provided with a suitable dial 35 which provides a visual indication of the rotational position of the commutator.

Sidewall 14 of housing 10 is provided with a mounting post 42 which projects inwardly therefrom and is bisected by a horizontal plane through the rotor axis. Mounting post 42, for the purpose set forth hereinafter, is also axially aligned with the contact track at the end of commutator 32 adjacent rear wall of the housing. Sidewall 14 is also provided with a pair of mounting posts 44 to which a terminal block assembly 46 is attached by means of screws 48.

Figure 5:
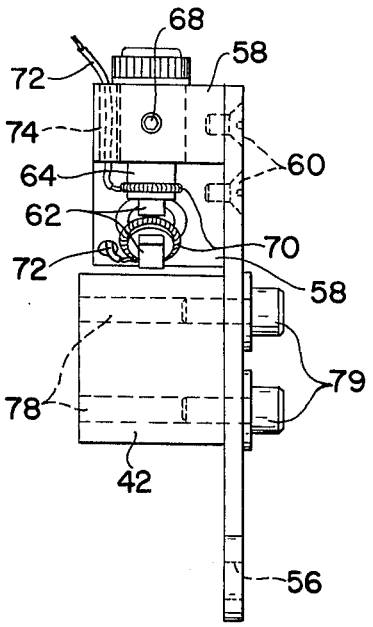
FIG. 5 is a detail view of one of the brush assemblies of the switch as seen along line 5—5 in FIG. 4.

As seen in FIGS. 1, 4 and 5, the rotary switch unit includes a pair of brush contact assemblies 50 and 52 mounted on an arcuate support arm 54 which is reversibly and adjustably mountable on support post 42, as described hereinafter. Support arm 54 is a steel plate having a circumferentially extent slightly greater than 180° and having an arcuate slot 56 extending from one end thereof toward the other along an arcuate path of about 95°. Brush assemblies 50 and 52 are attached to one side of plate 54 by means of a corresponding brush holder housing 58. Each housing 58 is of suitable insulating material and is attached to arm 54 by means of a corresponding screw 60. Each brush assembly includes a brush component 62 supported by a corresponding brush holder 64 mounted in a bore 66 in housing 58 and retained in place therein by means of a corresponding set screw 68. A garter-type spring 70 is mounted on holder 64, and a contact wire 72 extends through an opening 74 in bracket 58 and has one end soldered to the corresponding spring 70 and the other end attached to a corresponding terminal screw 76 of terminal block 46.

Mounting post 42 is provided with a pair of threaded openings 78 therethrough, and support arm 54 is adapted to be adjustably mounted on support post 42 by means of a pair of threaded studs 79 extending through slot 56 and into threaded engagement with the corresponding opening 78 in the support post. As seen in FIGS. 1 and 4, support arm 54 is mounted on the side of support post 42 facing front wall 20 of the housing, and brush assemblies 50 and 52 are positioned toward rear wall 18. Moreover, the brush assemblies are disposed above the axis of the commutator shaft and brushes 62 axially overlie the contact track on the corresponding end of commutator 32. In this position of mounting, support arm 54 and thus brush assemblies 50 and 52 are circumferentially adjustable relative to the housing to the extent provided by the length of slot 56 in arm 54.

Advantageously, for the purpose set forth hereinafter, support arm 54 is adapted to be mounted on the side of support post 42 facing rear wall 18 of the housing. When so mounted, brush assemblies 50 and 52 are positioned below the axis of commutator 32 and brushes 62 remain in axially aligned relationship with respect to the corresponding contact track of the commutator. To achieve the latter mounting, threaded studs 79 are removed from support post 42, and support arm 54 is rotated 180° transverse to the plane of FIG. 4. Support arm 54 is then positioned on the side of support post 42 adjacent rear wall 18. This positions brush assemblies 50 and 52 below the axis of commutator 32 and toward front wall 20 so that brushes 62 axially overlie the contact track. Threaded studs 79 are received in the corresponding ends of openings 78 to mount arm 54 on the support post, and the arm and brush assemblies are circumferentially adjustable relative to the housing to the extent provided by the length of slot 56.

Figure 7:
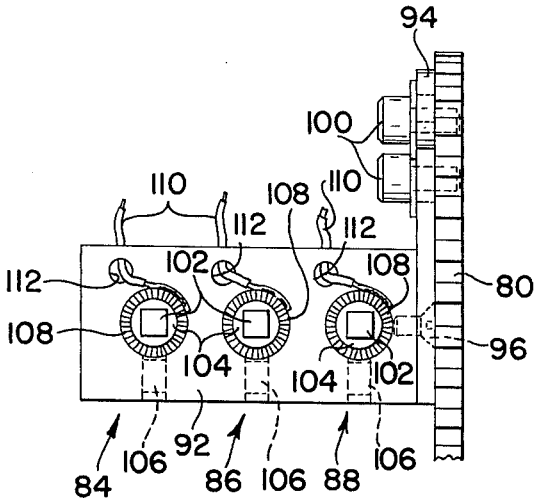
FIG. 7 is a detail view of another brush assembly of the switch taken along line 7—7 in FIG. 6.

The rotary switch further includes brush units which are adapted to be circumferentially adjusted relative to the housing during commutator rotation. More particularly, with reference to FIGS. 1, 3 and 6 of the drawing, a gear 80 is mounted on bearing sleeve 30 for rotation relative thereto and to housing 10. A washer 82 is interposed between front wall 20 of the housing and gear 80 to axially space the gear from wall 20. Gear 80 carries brush contact assemblies 84, 86, 88 and 90. As best seen in FIGS. 1 and 7, brush assemblies 84, 86 and 88 are carried by a common brush holder housing 92 of electrical insulating material mounted on an arcuate steel support arm 94 by means of a screw 96. Arm 94 is provided with an arcuate slot 98 having a circumferential extent of about 50°, and brush holder housing 92 extends from one side of the support arm to axially position brush assemblies 84, 86 and 88 relative to corresponding contact tracks on commutator 32. A pair of threaded studs 100 threadedly engage corresponding openings in gear 80, whereby arm 94 and thus brush assemblies 84, 86 and 88 are circumferentially adjustable relative to gear 80 to the extent provided by the length of slot 98.

Each of the brush assemblies 84, 86 and 88 is structurally similar to brush assemblies 50 and 52 described hereinabove and, in this respect, includes a brush component 102 supported by a corresponding brush holder 104. Each brush holder is in a corresponding opening in housing 92 and is retained in place with respect thereto by means of a set screw 106. Further, each brush holder is provided with a garter type spring 108, and a contact wire 110 is provided for each brush assembly and has one end thereof soldered to the corresponding garter spring 108. Contact wires 110 extend through corresponding openings 112 in housing 92 and have their other ends connected to a corresponding one of the contact screws 76 of terminal block assembly 46.

Figure 6:
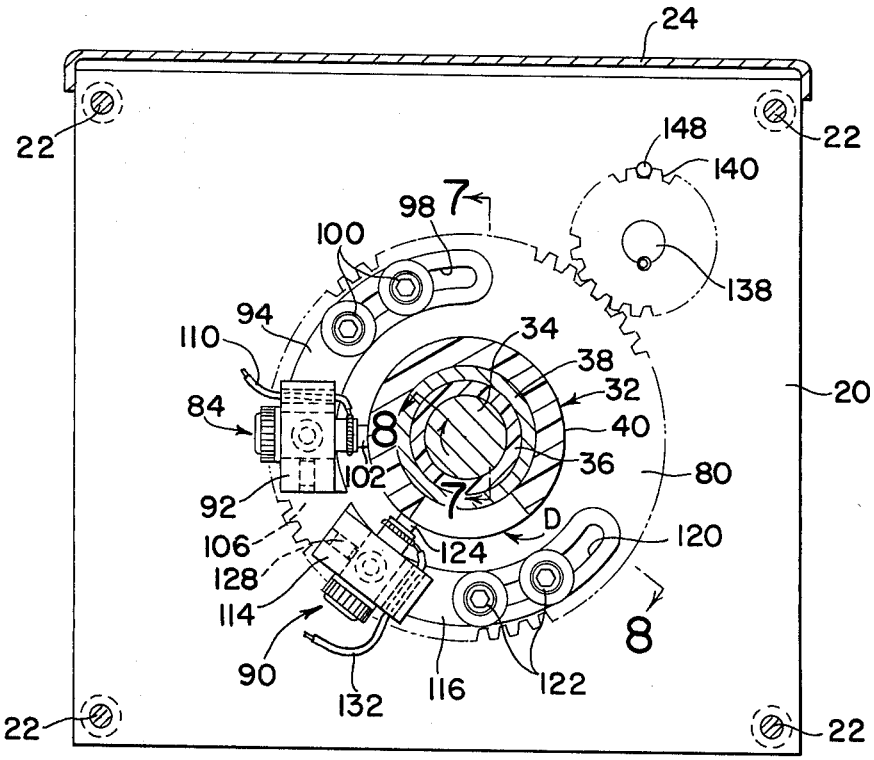
FIG. 6 is a sectional elevation view taken along line 6—6 in FIG. 1.

As best seen in FIGS. 6 and 8, brush assembly 90 is carried by a brush holder housing 114 of electrical insulating material. Housing 114 is mounted on an arcuate steel support arm 116 by means of a screw 118. Support arm 116 is provided with an arcuate slot 120 having a circumferential extent of about 50°, and a pair of threaded studs 122 are cooperatively received in corresponding openings in gear 80 to mount support arm 116 and thus brush assembly 90 on the gear for circumferential adjustment relative thereto to the extent provided by the length of slot 120.

Brush assembly 90 is structurally similar to the brush assemblies described hereinabove and, in this respect, includes a brush component 124 carried by a brush holder 126 disposed in a corresponding opening in housing 114 and retained in place with respect thereto by a set screw 128. A garter type spring 130 is mounted on holder 126, and a contact wire 132 extends through an opening 134 therefor in housing 114 and has its inner end soldered to garter spring 130 and its outer end connected to terminal block assembly 46 by a corresponding one of the terminal block screws 76. Housing 114 axially positions brush assembly 90 relative to a corresponding contact track of commutator 32.

As mentioned hereinabove, gear 80 is rotatable relative to commutator 32 and housing 10, whereby the positions of brush assemblies 84, 86, 88 and 90, once securely mounted on gear 80, are circumferentially adjustable relative to housing 10 by rotating gear 80 relative thereto. Gear 80 is rotatable 360° relative to housing 10 and is adapted to be locked against rotation in a selected position of rotation thereof. Any suitable arrangement can be provided for rotating and locking gear 80.

Preferably, gear 80 is rotatable from outside the housing and during operation or use of the switch assembly. In the embodiment shown, this is achieved by means of an adjusting mechanism 136 operatively associated with gear 80 and housing 10 as shown in FIGS. 1, 2, 6 and 9 of the drawing. Adjusting mechanism 136 includes a shaft 138 supported by front wall 20 of housing 10 for rotation and axial displacement relative thereto. A pinion gear 140 is mounted on the inner end of shaft 138, and the teeth of gear 140 mesh with the teeth of gear 80. The outer end of shaft 138 is provided with an actuating knob 142, and a coil spring 144 biases shaft 138 and gear 140 toward front wall 20 of the housing. A spacing washer 146 is disposed between gear 140 and wall 20, and a pin 148 is mounted on wall 20 in alignment with the space between the teeth of gear 140. Accordingly, pin 148 is adapted to engage between adjacent teeth of gear 140 to prevent rotation thereof, whereby rotation of gear 80 is prevented due to the meshing engagement of the teeth thereof with the teeth of gear 140.

Gear 80 and gear 140 are axially positioned and dimensioned for the teeth thereof to remain in engagement upon axial displacement of shaft 138 inwardly of housing wall 20, and pin 148 is of a length whereby the latter displacement of shaft 138 disengages the teeth of gear 140 from pin 148. Therefore, when knob 142 is pushed toward front wall 20 of the housing and then rotated gear 80 is rotated relative to the housing to achieve circumferential adjustment of the brush contact assemblies mounted thereon. Upon release of knob 142 spring 144 biases gear 140 toward front wall 20 of the housing, whereby pin 148 engages between adjacent teeth of gear 140 to lock the latter gear and thus gear 80 against rotation relative to the housing.

FIG. 10 is a plan view of commutator 32 which, to facilitate the insuing description, is shown without fiber glass portion 40 described hereinabove, Referring to FIG. 10, commutator assembly 32 includes a plurality of axially spaced apart cams segments A–E integral with hub 38 and defining circumferentially extending contact tracks. In the embodiment shown, cam segments A–D are axially aligned, respectively, with brush assemblies 88, 86, 84 and 90, and cam segment E is axially aligned with brush assemblies 50 and 52.

The several cam segments and brush assemblies are designed to perform a sequence of switching functions as described more fully hereinafter. The cam configurations are shown in FIGS. 11–15 looking in the direction from front wall 20 of the switch housing toward rear wall 18, and the corresponding brush assemblies are shown schematically in association therewith. For the disclosed sequence of switching functions, with the brush contacts mounted as shown, rotation of the commutator assembly is counterclockwise as shown by arrows R in FIGS. 11–15. Further, to facilitate the relative orientation of the cam segments and brush assemblies during rotation of the commutator, the 0° reference point for commutator rotation is above the commutator axis and on a vertical line therethrough, as seen in FIGS. 11–15.

With the latter orientation in mind, it will be seen from FIG. 11 that cam segment A provides a contact track having a circumferential extent of 180° orientated as shown when the commutator is in the 0 position. From FIG. 12 it will be seen that cam segment B provides a contact track having a circumferential extent of 240°, and from FIG. 13 it will be seen that cam segment C provides a continuous contact track circumferentially of the commutator assembly. Cam segment D, as seen in FIG. 14, provides a contact track having a circumferential extent of 75°, and cam segment E as seen in FIG. 15 provides a contact track having a circumferential extent of 80°. It will be appreciated, of course, that cam segments B, D and E are oriented as shown when the commutator assembly is in the 0° position.

For the sequence of switching functions to be achieved in the disclosed arrangement, brush assemblies 84, 86 and 88 are positioned within housing 10 at the 270° location with respect to the point of orientation, brush assembly 90 is positioned at about the 215° location, and brush assembly 52 is located at about the 10° position. Brush contact assemblies 50 and 52 are circumferentially aligned, whereby cam segment 80 is common to both of these brush assemblies. Brush assembly 50 is positioned at about the 315° location relative to the point of orientation.

The sequence of switching functions achieved by the commutator contact tracks and brushes described hereinabove is shown in the switch bar chart of FIG. 16 wherein the solid bars designate engagement of the brushes with the corresponding contact track and closure of an electrical circuit therethrough. Accordingly, it will be appreciated that cam segment C provides a feeder contact continuously engaging the brush component of brush assembly 84 to provide an electrical input to the commutator. With the commutator assembly oriented in the 0° position, it will be seen that cam segment B engages the brush component of brush assembly 86 to establish a circuit therebetween through the first 174° of commutator rotation. From the 174° point to the 294° of rotation the brush of assembly 86 rides on fiber glass portion 40 of the commutator whereby the circuit through cam segment B and brush assembly 86 is open. At the 294° position cam segment B again engages the brush of assembly 86 to close the circuit therebetween for the remainder of the 360° rotation of the commutator.

Cam segment A engages the brush component of brush assembly 88 between the 144° position of rotation of the commutator and the 324° position, thus to generally symmetrically bridge the window or non-contact portion of the commutator aligned with cam segment B. Cam segment E engages the brush component of brush assembly 52 between the 200° and 280° positions of commutator rotation and cam segment E engages the brush component of brush assembly 50 between about the 145° and 225° positions of commutator rotation. Cam segment D engages the brush component of brush assembly 90 from the 0° to the 75° positions of commutator rotation.

As mentioned hereinabove, brush assemblies 50 and 52 are both circumferentially aligned with cam segment E, and this arrangement provides for two switching functions to be achieved through the same cam contact track or, alternatively, the selective use of one of the brush contacts for a given program while the other serves as a spare. This arrangement accordingly lends additional versatility to the switch unit.

The mounting arrangements for the several brush assemblies advantageously provide for bi-directional rotation of the commutator to achieve the same program and the same sequence of make and break contact in response to such bi-directional rotation. In this respect, as described hereinabove, support arm 54 is adapted to be mounted on the opposite side of support post 42 from that shown in FIG. 1 and in a manner whereby brush contact assemblies 50 and 52 are positioned beneath the axis of the commutator shaft and in axial alignment with cam segment E. Accordingly, brush contact assemblies 50 and 52 are adapted to be reoriented in a generally diametrically opposed location in housing 10, and slot 56 in support arm 54 facilitates circumferential adjustment of the brush assemblies relative to the housing in each of the two opposed locations. Further, as described hereinabove, gear 80 supporting brush contact assemblies 84, 86, 88 and 90 is adapted to be rotated 360° relative to housing 10, whereby the brush contact assemblies carried thereby are adapted to be relocated in positions generally diametrically opposed to the positions thereof illustrated in FIG. 6 of the drawing. Moreover, the slots in support arms 94 and 116 together with adjusting mechanism 136 provide for adjusting the circumferential positions of the latter brush contact assemblies in either of the diametrically opposed locations thereof.

In connection with the commutator cam structure disclosed, the contact adjustment capability advantageously provides for the several brush members to be reoriented to achieve the same make and break contact with the corresponding cam contact tracks when the commutator is rotated in the opposite direction from that described hereinabove in connection with the physical arrangement shown in the drawings. The 0° point of orientation for the commutator will change when the brush contact assemblies are relocated in the diametrically opposed locations of the housing, and minor adjustments of the brush assemblies relative to the corresponding support members therefor may be necessary to achieve duplication of the make and break points. In any event, however, the adjustment capabilities enable the necessary minor adjustments to achieve duplication of the desired program sequence between the brush assemblies and cam segments. This advantageously enables the commutator to be driven in opposite directions, thus avoiding the necessity of providing a different commutator assembly structure to achieve reverse driven operation of the switch.

In accordance with another aspect of the invention, as best seen in FIGS. 1 and 3 of the drawing, commutator assembly 32 and hosuing 10 are provided with a motion detecting assembly 150 including a U-shaped motion pick-up member 152 mounted on rear wall 18 of housing 10 and a segmented disc 154 mounted on commutator shaft 34 for rotation therewith by means of pins 156. A peripheral portion of disc 154 is received in the gap between the legs of the U. Further, the disc is produced from insulating material and is provided with a plurality of radially extending circumferentially spaced apart contact strips of conductive material, not shown. Member 152 is of magnetic material and is energized by a suitable winding, not shown, to establish a magnetic field across the gap between the legs of the U. The magnetic field is intermittently interrupted by the conductive strips on disc 154 in response to rotation of the disc through the gap, whereby an electrical signal is generated as an output from pick-up member 152. A motion detector device of the foregoing structure and operation is commercially available from Electronic Counters and Controls, Inc. of Lake Bluff, Illinois under the manufacturers product designation Zero Speed Switch.

If the rotary switch is used in conduction with a press, the output signal from sensor 152 can be connected to a control relay or the like, not shown, which is operable to brake and/or declutch the press device. The output signal is indicative of commutator speed, and should the commutator speed fall below a preselected level which would be indicative, for example, of clutch slippage due to wear or shaft breakage in the press, the output signal operates to provide the desired safety control function.

In accordance with yet another aspect of the invention, as seen in FIG. 1, electrical filters 158 are connected between each of the terminal screws 76 and ground, except for the terminal screw to which lead 110 of input contact assembly 84 is connected. Filters 158 are metal oxide varistors available from the General Electric Company under the latters product designation GE-MOV. Filters 158 advantageously suppress arcing during make and break engagement between the corresponding brush and contact track and thus minimize damage to the brass contact tracks.

While considerable emphasis has been placed herein on the specific structures of certain of the components of the preferred embodiment, it will be appreciated that many different structures and modifications of the disclosed structures can be employed without deparating from the principles of the present invention. In this respect, for example, the brush contact assemblies and the conductive cam segments could be replaced, respectively, by mechanically actuated switches and actuating cam members mounted on the commutator shaft. Further, arrangements other than that specifically shown can be provided for rotating gear 80 from outside the switch housing and for locking the gear against rotation, and a component other than gear 80 can be employed to support the corresponding contact brushes for rotation about the axis of the commutator shaft. Moreover, while a particular cam segment and fixed contact arrangement is shown by which reverse drive of the commutator is possible to achieve a desired sequence of make and break functions, it will be appreciated that the adjustable contact structures enable the desired bidirectional commutator drive and, the other advantages provided thereby to be achieved with many other commutator cam segment arrangements and switching programs.

As many embodiments of the present invention can be made and as many changes can be made in the embodiment herein illustrated and described, it is to be distinctly understood that the foregoin descriptive matter is to be interpreted merely as illustrative of the present invention and not as a limitation.

We claim:

1. In a rotary switch including a housing, rotor means having an axis and supported in said housing for rotation about said axis, switch contact elements in said housing, means on said rotor means cooperable with said contact elements during rotation of said rotor means to achieve make and break switching functions, and means supporting said contact elements in said housing, the improvement comprising: said supporting means including an arm extending circumferentially of said rotor at least 90° and having axially opposite sides, at least one of said contact elements being circumferentially fixed on said arm, said arm and said one contact being reversible in said housing with respect to the direction of said axis, mounting means for supporting said arm in the reverse positions thereof to selectively position said one contact element in axially aligned and generally diametrically opposed first and second circumferential areas in said housing, and means releaseably interengaging said arm and mounting means for adjusting the position of said arm and thus said one contact element relative to said mounting means in circumferentially opposite directions in each of said first and second areas.

2. The improvement according to claim 1, wherein said arm has a line of curvature circumferentially of said axis and said means releasably interengaging said arm and mounting means includes means to releasably clamp said arm to said mounting means and to guide positional adjustment of said arm relative to said mounting means along said line of curvature.

3. In a rotary switch including a housing, rotor means having an axis and supported in said housing for rotation about said axis, switch contact elements in said housing, means on said rotor means cooperable with said contact elements during rotation of said rotor means to achieve make and break switching functions, and means supporting said contact elements in said housing, the improvement comprising: said supporting means including an arm carrying at least one of said contact elements, mounting means cooperable with said arm to selectively position said one contact element in axially aligned and generally diametrically opposed first and second cicumferential areas in said housing, and means releaseably interengaging said arm and mounting means for adjusting the position of said one contact element relative to said mounting means in circumferentially opposite directions in each of said first and second areas, said arm having a line of curvature circumferentially of said axis, said means releaseably interengaging said arm and mounting means including means to releaseably clamp said arm to said mounting means and to guide positional adjustment of said arm relative to said mounting means along said line of curvature, said mounting means being a mounting member fixed relative to said housing and having axially spaced opposite sides, said arm being selectively mountable on each ofsaid opposite sides of said member, and said one contact element on said arm in each of the mounting positions of said arm being axially aligned with a plane transverse to said axis and bisecting said member.

4. The improvement according to claim 3, wherein said means to releasably clamp said arm is defined by an arcuate slot in said arm along said line of curvature, and headed fastener means extending through said slot and interengaged with said mounting member.

5. In a rotary switch including a housing, rotor means having an axis and supported in said housing for rotation about said axis, switch contact elements in said housing, means on said rotor means cooperable with said contact elements during rotation of said rotor means to achieve make and break switching functions, and means supporting said contact elements in said housing, the improvement comprising: said supporting means including an arm extending circumferentially of said axis at least 90°, at least one of said contact elements being fixed on said arm, mounting means cooperable with said arm to selectively position said one contact element in axially aligned and generally diametrically opposed first and second circumferential areas in said housing, means releaseably interengaging said arm and mounting means for adjusting the position of said arm and said one contact element relative to said mounting means in circumferentially opposite directions in each of said first and second areas, said mounting means being supported in said housing for rotation relative to said rotor means and about said axis, and means releaseably interengaging said mounting means and housing against rotation of said mounting means relative to said rotor means.

6. The improvement according to claim 5, wherein said means releasably interengaging said mounting means and housing includes means for rotating said mounting means.

7. The improvement according to claim 5, wherein said mounting means is a first gear, and said means releasably interengagng said mounting means and housing includes a second gear drivingly interengaging said first gear and supported by said housing for rotatioan relative thereto, and means to releasably lock said second gear against rotation relative to said housing.

8. In a rotary switch including a housing, rotor means having an axis and supported in said housing for rotation about said axis, switch contact elements in said housing, means on said rotor means cooperable with said contact elements during rotation of said rotor means to achieve make and break switching functions, and means supporting said contact elements in said housing, the improvement comprising: said supporting means including an arm carrying at least one of said contact elements, mounting means cooperable with said arm to selectively position said one contact element in axially aligned and generally diametrically opposed first and second circumferential areas in said housing, means releaseably interengaging said arm and mounting means for adjusting the position of said one contact element relative to said mounting means in circumferentially opposite directions in each of said first and second areas, said mounting means being supported in said housing for rotation relative to said rotor means and about said axis, means releasably interengaging said mounting means and housing against rotation of said mounting means relative to said rotor means, said mounting means being a first gear, said means releaseably interengaging said mounting means and housing including a second gear drivingly interengaging said first gear and supported by said housing for rotatioan relative thereto, and means to releaseably lock said second gear against rotation relative to said housing, said arm having a line of curvature and a slot therethrough following said line of curvature, and said means releaseably interengaging said arm and mounting means including said slot and headed fastener means extending therethrough and interengaging with said first gear.

9. The improvement according to claim 8, wherein said second gear is mounted on a shaft having an axis of rotation parallel with said axis of said rotor means, means defining an opening through said housing supporting said shaft and second gear for rotation and for axial displacement relative to said housing between first and second positions, said shaft having an actuator end outside said housing for rotating and axially displacing said second gear, and pin means fixed in said housing and engaging said second gear means in said first axial position thereof to lock said second gear means against rotation, said second gear means in said second axial position being disengaged from said pin means for rotation, and said first and second gear means being in meshing interengagement in both said first and second positions.

10. The improvement according to claim 9, and spring means axially biasing said shaft and second gear toward said first position.

11. In a rotary switch including a housing, rotor means having an axis and supported in said housing for rotation about said axis, switch contact elements in said housing, means on said rotor means cooperable with said contact elements during rotation of said rotor means to achieve make and break switching functions, and means supporting said contact elements in said housing, the improvement comprising: said supporting means including an arm carrying at least one of said contact elements, mounting means cooperable with said arm to selectively position said one contact element in axially aligned and generally diametrically opposed first and second circumferential areas in said housing, means releaseably interengaging said arm and mounting means for adjusting the position of said one contact element relative to said mounting means in circumferentially opposite directions in each of said first and second areas, and means to sense the speed of rotation of said rotor means, said sensing means being operable to generate an electrical signal indicative of said rotational speed.

12. In a rotary sequencing switch including a housing, rotor means having an axis and supported by said housing for rotation about said axis, first and second switch contact elements in said housing in different axial locations with respect to said rotor means, means on said rotor means movable therewith along circumferential paths at each of said locations and cooperable with the corresponding contact element during rotation of said rotor means to achieve a switching function, and first and second support means respectively supporting said first and second contact elements at the corresponding location, the improvement comprising: said first support means including a first support member fixed in said housing and having axially opposite sides, an arm carrying said first contact element, said arm being removably mountable on said opposite sides of said first support member to selectively position said contact element in generally diametrically opposed areas in said housing, and means adjustably interengaging said arm and first support member for adjusting the circumferential position of said first contact element relative to said housing in each of said areas, said second support means including a second support member in said housing coaxial with and rotatable relative to said rotor means, means mounting said second contact element on said second support member for rotation therewith, said second support member being rotatable to selectively position said second contact element in generally diametrically opposed areas in said housing, and means releasably interengaging said second support member with said housing against rotation of said second member relative to said housing.

13. The improvement according to claim 12, wherein said means mounting said second contact element on said second support member includes means releasably supporting said second contact element, for adjustment relative to said second support member and circumferentially of said axis.

14. The improvement according to claim 13, wherein said second support member is a gear rotatable 360° about said axis, and said means releasably interengaging said second support member and housing includes a pinion rotatably supported by said housing and drivingly engaging said gear, and means to releasably lock said pinion against rotation relative to said housing.

15. The improvement according to claim 14, wherein said pinion is mounted on a shaft extending through said housing and having an outer end, said shaft being axially displaceable relative to said housing to move said pinion between first and second positions, pin means in said housing engaging said pinion in said first position to prevent rotation thereof, said pinion being disengaged from said pin means in said second position, and said gear and pinion being in meshing interengagement in both said first and second positions.

16. The improvement according to claim 15, and spring means biasing said shaft and pinion toward said first position of said pinion.

17. The improvement according to claim 15, and further including means to sense the speed of rotation of said rotor means, said sensing means being operable to generate an electrical signal indicative of said rotational speed.

18. The improvement according to claim 12, and further including means to sense the speed of rotation of said rotor means, said sensing means being operable to generate an electrical signal indicative of said rotational speed.

19. The improvement according to claim 12, and terminal board means mounted in said housing and including a terminal for at least one of said first and second contact elements, conductr means electrically connecting said terminal and said one contact element, and electrical filter means connected between said terminal and ground.

* * * * *